US005356008A

United States Patent [19]

Chung

[11] Patent Number: 5,356,008

[45] Date of Patent: Oct. 18, 1994

[54] COMPOSITE COASTER TRAY

[76] Inventor: Yueh-Min Chung, 1500 Campus Dr., Berkeley, Calif. 94708

[21] Appl. No.: 93,015

[22] Filed: Jul. 19, 1993

[51] Int. Cl.[5] ..... B65D 85/62

[52] U.S. Cl. ..... 206/449; 206/560; 206/564; 248/346.1

[58] Field of Search ..... 206/526, 557, 558, 560, 206/561, 564, 565, 449; 248/346, 346.1

[56] References Cited

U.S. PATENT DOCUMENTS

| | | | |
|---|---|---|---|
| 4,546,946 | 10/1985 | Jenison | 248/346.1 |
| 4,643,381 | 2/1987 | Levy | 248/346.1 |
| 4,927,020 | 5/1990 | Randy | 206/565 |
| 5,018,695 | 5/1991 | Bishop | 248/346.1 |
| 5,086,712 | 2/1992 | Clark | 248/346.1 |

*Primary Examiner*—Jimmy G. Foster

[57] ABSTRACT

The coaster tray comprising a base tray and the movable coaster units, functioning in two way: In one way, it is an integral tray for a complete arrangement of a coffee or tea set with pots and cups; in the other way, the coaster units can be detached from the base tray and served individually for individual pots or cups; the coaster units, while grouping together, having tongue joint devices at sides, sliding into the grooves at the inner edge of the bracing bar of the base tray, being locked at edges of the base tray by edge locks; for individual serving, removing edge lock, sliding each coaster units out of the groove of the base tray; the design features of each coaster unit, such as shapes, colors, etc., being parts of the base tray as a whole.

2 Claims, 3 Drawing Sheets

COMPOSITE COASTER TRAY

FIELD

The invention relates to a tray device which supports a plurality of coaster units which can be detached from a base tray and served as individual coasters.

BACKGROUND OF THE INVENTION

Trays and coasters are well known portable serving devices. A tray is mostly sized to carry a variety or a plurality of vessels or food. While a coaster is mostly the support of a beverage glass or cup to protect the table surface.

The present invention deals with the arrangement of a plurality of coaster units, instead of singular one. Also the present invention investigates the shape and the organization of both the tray and the units that are engaged in the tray. The shapes of a plurality of coaster units are the physical parts of the whole tray.

The composite coaster tray combines and advances the conventional tray and coaster into one flexible device which can be either assembled as one tray or be disassembled into individual coaster units.

SUMMARY OF THE INVENTION

The composite coaster tray serves to major "functions". First, it can hold a tea or coffee set as one grouping arrangement; second, it can be disassembled into seperate coaster units to hold each pot and cup for individual serving. The said coaster tray thus composes of two major parts, one is a base tray, the other is the movable coaster units which can be disassembled from the base tray or assembled back onto the base tray as one organized component.

The coaster units are engaged in the base tray with the tongue and groove device. The coasters with tongues at two opposed edges can be removed from the base tray by sliding along the groove towards the open ends of the base tray. In assembling configuration, the coaster units are received in the channels of the base tray and the open ends are obstructed by locking bars to prevent the coasters from sliding out of the channels of the base tray. The locking bars being received in the locking grooves at the open ends can be removed to allow the detachment of the coaster units.

BRIEF DESCRIPTION OF THE DRAWINGS

The drawings of the invention are presented by way of example and not by way of limitation of the principles of this invention.

DESCRIPTION OF THE PREFERRED EMBODIMENT

The following detailed description of the preferred embodiment presents the principal structure and the basic operation of the invention in reference to the drawings.

STRUCTURE

Figure 1:
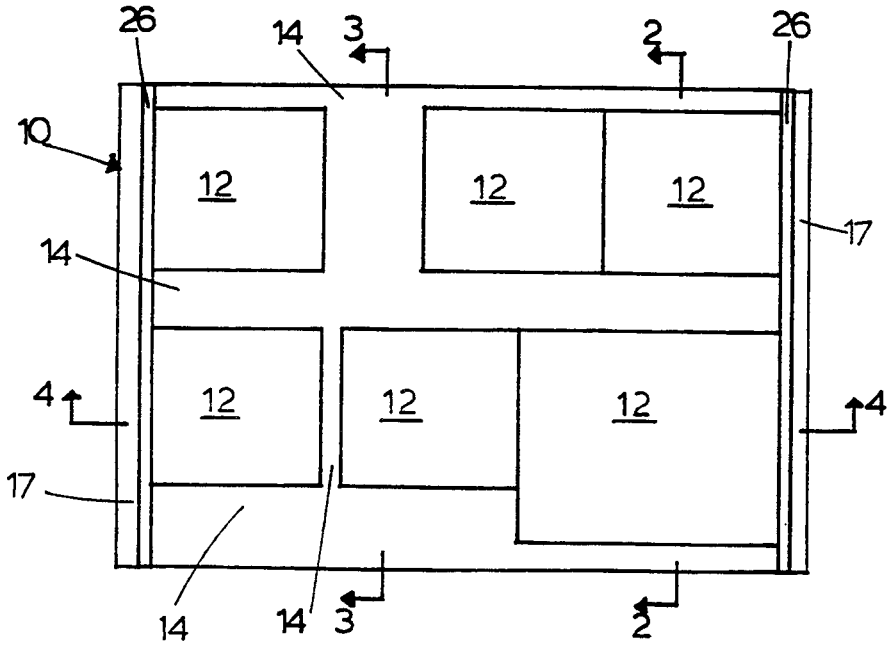
FIG. 1 is a top plan view of the composite coaster tray of the invention.
Figure 2:
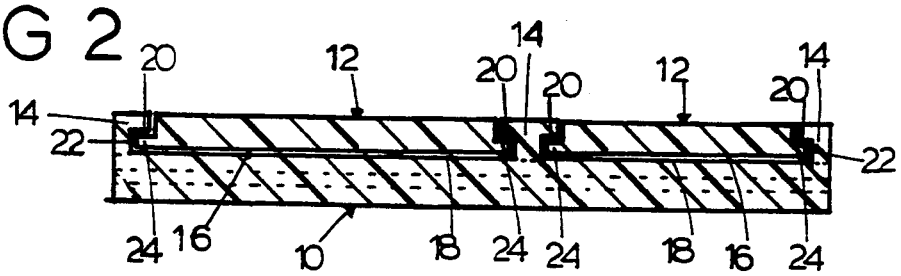
FIG. 2 is a cross section taken at 2—2 on the view shown in FIG. 1.
Figure 3:
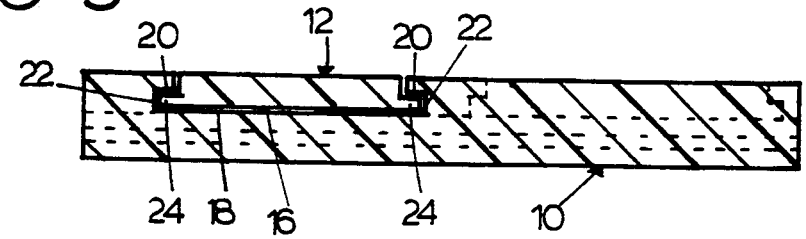
FIG. 3 is a cross section taken at 3—3 on the view shown in FIG. 1.
Figure 4:
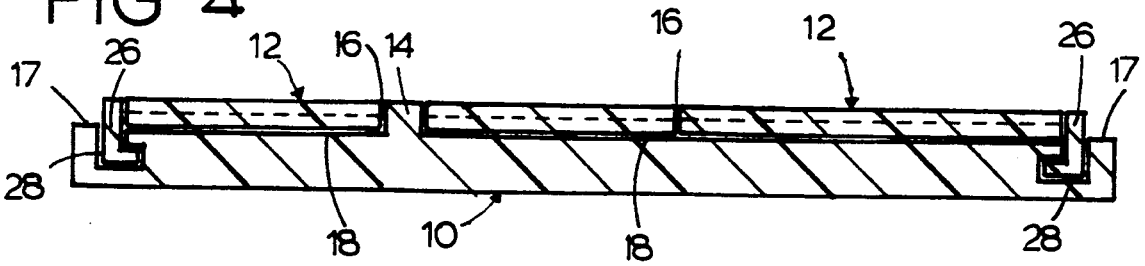
FIG. 4 is a cross section taken at 4—4 on the view shown in FIG. 1.
Figure 5:
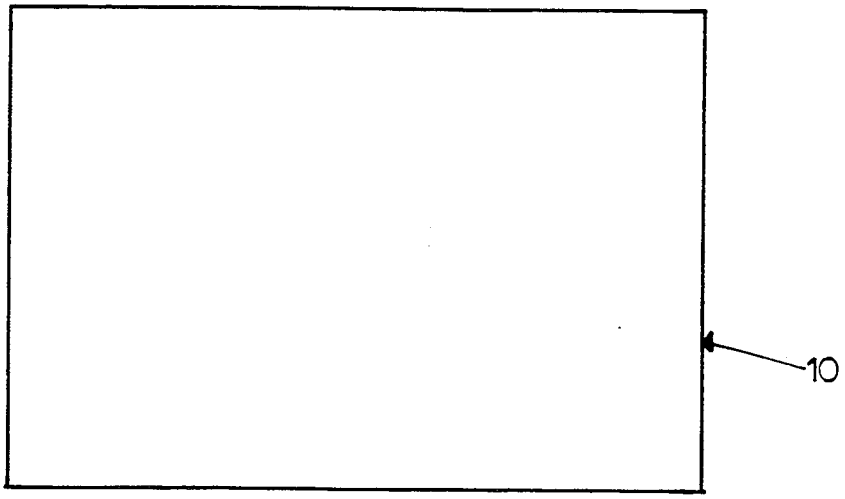
FIG. 5 is a base plan view of the composite coaster tray of the invention.
Figure 6:
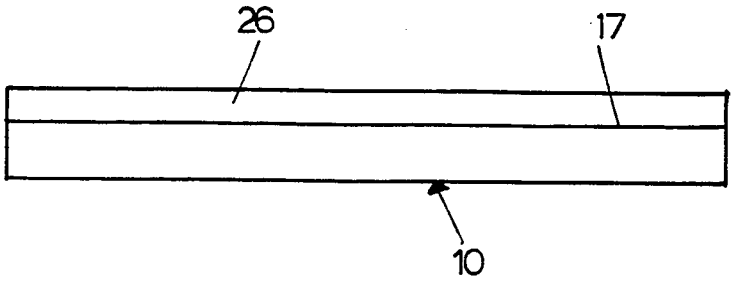
FIG. 6 is an elevational view at the shorter ends of the composite coaster tray.
Figure 7:
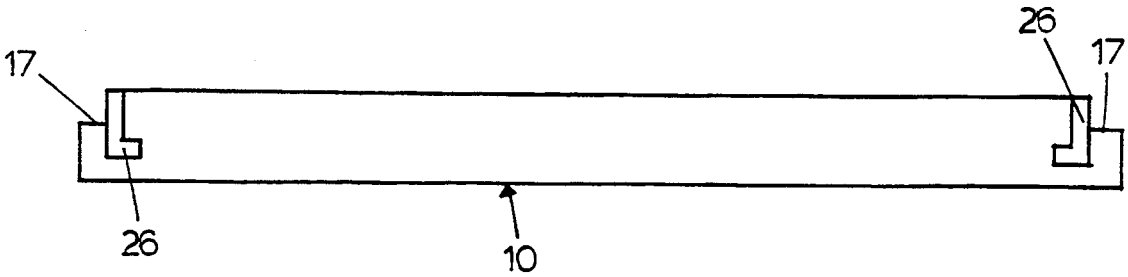
FIG. 7 is an elevational view at the longer ends of the composite coaster tray.
Figure 8:
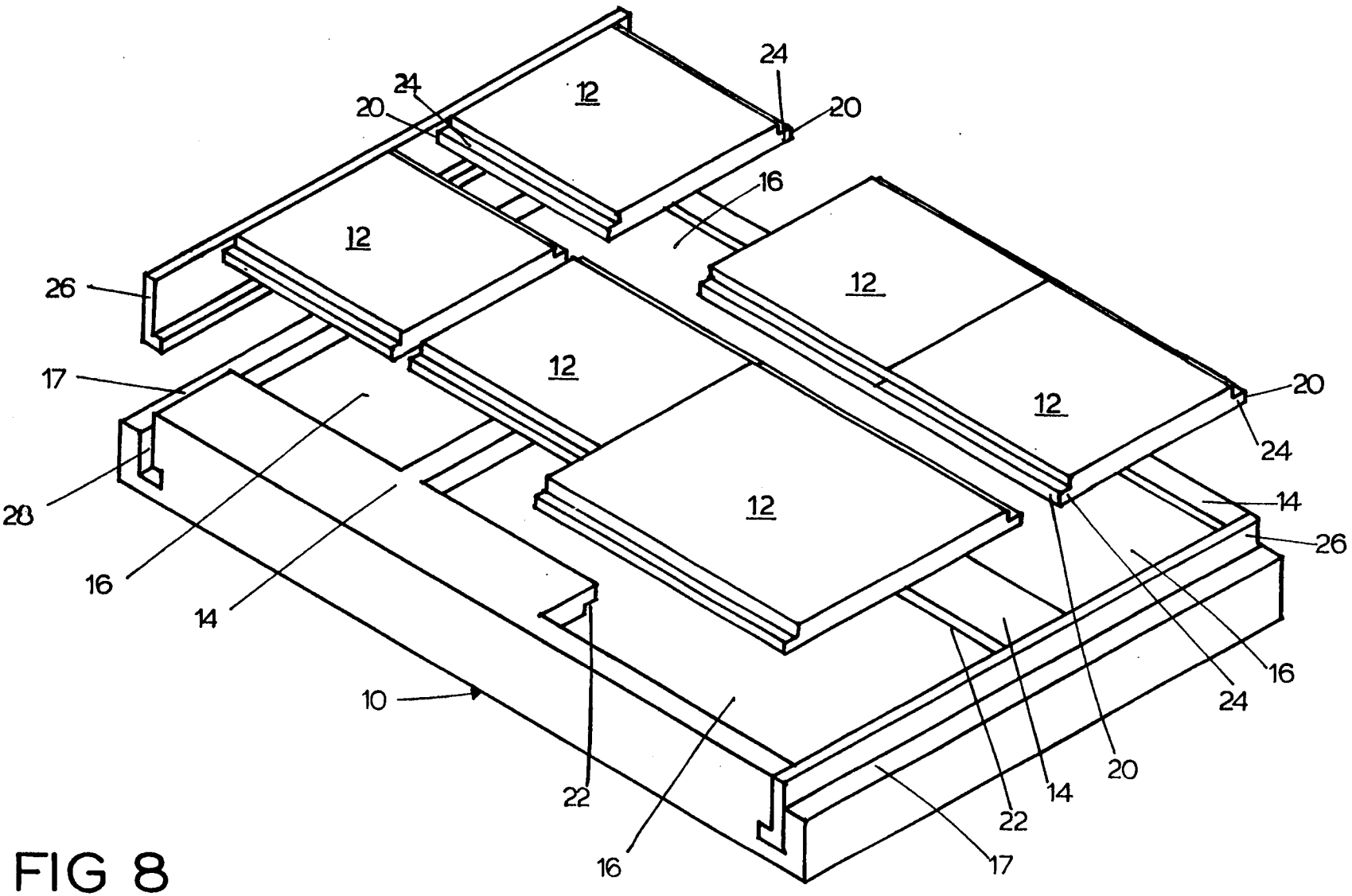
FIG. 8 is an exploded isometric view of the composite coaster tray showing the coaster units and one of the edge locking bar being removed from the channels and grooves of the base tray.

The composite coaster tray as shown in FIGS. 1 to 8 comprises two major parts, one is a base tray 10, the other is a plurality of coaster units 12. The latter are received in the channels 16 of the base tray 10 on the supporting surfaces 18 and engaged in the sliding grooves 22 of the bracing bar 14 of the base tray 10 through the projecting tongues 24 at the opposed edges 20 of the coaster units 12. Each channels 16 of the base tray 10 has an open end edge 20. Parallel to each open end edge 17 of the base tray 10, there is an edge lock groove 28 which receives an edge locking bar 26.

OPERATION

To serve the tea or coffee as a complete set of arrangement, each coaster units 12 are supported on the respective supporting surfaces 18 of the channels 16 and engaged with the sliding groove 22 of the bracing bar 14 through the projecting tongues 24. The two edge lock bars 26 are received in the edge lock groove 28 to obstruct the open end edge 17 and prevent the coaster units from sliding out.

While serving tea or coffee cups on individual coaster units 12, one first removes the edge lock bars 26 by sliding them out from the edge lock groove 28 and then slides individual coaster units 12 towards the open end edge 17 along the sliding groove 22 till the units 12 are completely detached from the base tray 10. One may reverse the previous operation to reassemble the coaster units back onto the base tray as one composite tray.

I claim:

1. A composite coaster tray comprising:

a base tray for supporting a plurality of coaster units, said base tray including a plurality of bracing bars being spaced to define channels there between, each channel comprising an upper supporting surface for supporting one or more coaster units, each said channel having an open end edge;

a plurality of said coaster units, said coaster units being sized for being received in said channels and for being supported by said supporting surface, each coaster unit having opposed edges;

engaging means for slidably engaging the coaster units to the bracing bars and for maintaining the coaster units supported on the respective supporting surfaces of the channels, said engaging means including facing, opposed sliding grooves defined by said bracing bars, and including projecting tongues defining an angled notch on each of said opposed edges, said tongues adapted to be received in said grooves for sliding movement in said channel;

locking means for selectively preventing said coaster units from being removed from said channels at respective end edges until the locking means is unlocked;

whereby when the coaster units are in the base tray, the composite tray may support together a complete arrangement of a serving set of pots and cups, and when the coasters are detached from said base tray, the coasters may be served individually with individual pots or cups.

2. A composite tray as set forth in claim 1, wherein said locking means includes a edge locking groove in said base tray at one of said open end edges and extending transversely to said bracing bars, and includes an edge locking bar adapted to be received in said edge locking groove to obstruct said one open end edge.

* * * * *